US005984206A

United States Patent [19]

Leitzel et al.

[11] Patent Number: 5,984,206

[45] Date of Patent: Nov. 16, 1999

[54] PAINT SUPPLY SYSTEM

[75] Inventors: Craig M. Leitzel, Oregon City; Don R. Rhyne, Boring, both of Oreg.

[73] Assignee: LRK Supply, Inc., Estacada, Oreg.

[21] Appl. No.: 09/092,796

[22] Filed: Jun. 5, 1998

Related U.S. Application Data

[60] Provisional application No. 60/048,860, Jun. 6, 1997.

[51] Int. Cl.[6] ..... B05B 7/30

[52] U.S. Cl. ..... 239/345; 239/379

[58] Field of Search ..... 239/302, 345, 239/346, 375, 376, 377, 378, 379; 141/364, 365, 366

[56] References Cited

U.S. PATENT DOCUMENTS 4,140,160 2/1979 Glacking ..... 141/364

5,402,920 4/1995 Dhillon ..... 141/364

*Primary Examiner*—Andres Kashnikow

*Assistant Examiner*—Jorge S. Bocanegra

*Attorney, Agent, or Firm*—Klarquist Sparkman Campbell Leigh & Whinston LLP

[57] ABSTRACT

The present invention refers to a paint supply system. A fixed reservoir is connected to a pump by a short rigid tube. The reservoir is of sufficient capacity to hold at least one gallon of paint. The supply conduit to the pump is very short therefore allowing little paint to be wasted and also simplifying its cleaning. The reservoir has a holder to support the one gallon paint can at an elevation above the bottom of the reservoir and above the surface of the paint in the reservoir.

10 Claims, 1 Drawing Sheet

PAINT SUPPLY SYSTEM

CROSS REFERENCE TO RELATED CASE

This application claims the benefit of U.S. Provisional Application No. 60/048,860, filed Jun. 6, 1997, incorporated herein by reference.

BACKGROUND OF THE INVENTION

The present invention relates to spray paint equipment and particularly to equipment for supplying paint to a paint gun.

In the past, the common practice has been to pump paint from a bucket, via a long supply tube, to a pump which supplies pressurized paint to a spray gun.

It is a disadvantage of these prior systems that a considerable amount of paint is wasted in filling the long supply tube. For small jobs, a considerable percentage of the paint is wasted since a substantial amount is required to fill the supply tube prior to spraying. It is necessary to discard any paint left in the tube at the end of the job. It is also a burden to clean the long supply tube after each use.

SUMMARY OF THE INVENTION

According to the present invention, a fixed reservoir is connected to the pump by a short rigid tube. The reservoir is of sufficient capacity to hold at least one gallon of paint so it can be filled by pouring in the entire contents of a one-gallon bucket.

Because the supply conduit to the pump is very short, little paint is wasted and cleaning is simplified.

DETAILED DESCRIPTION

Figure 2:
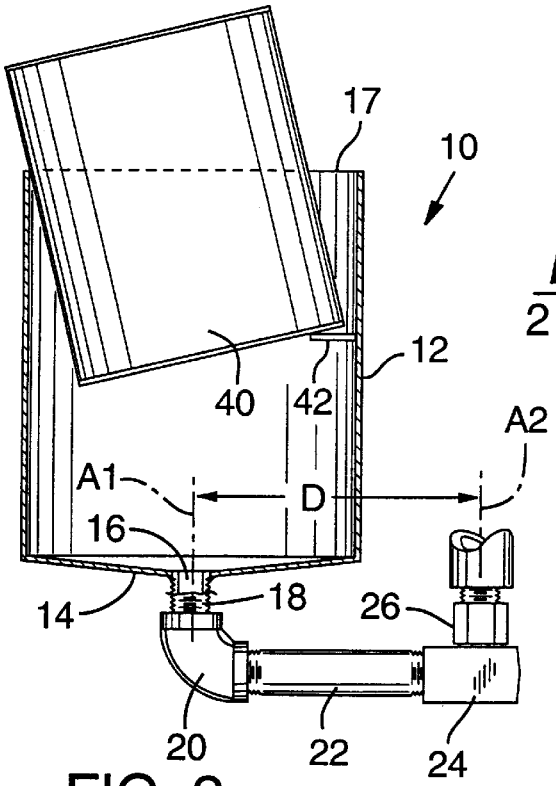
FIG. 2 is a vertical sectional view taken along line 2—2 of FIG. 1.
Figure 1:
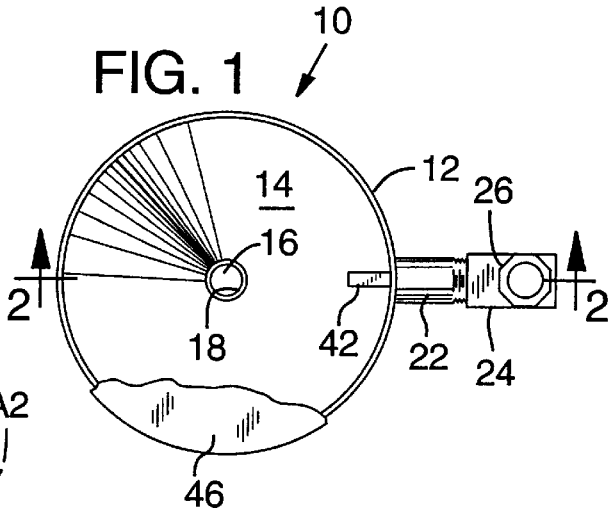
FIG. 1 is a top plan view of a paint reservoir with supply tube according to the present invention.

A paint supply system according to the present invention includes a reservoir or vessel 10. In the illustrated preferred embodiment, the vessel 10 has a cylindrical wall 12 and a frustroconical bottom wall 14. The bottom wall 14 defines an outlet 16 to which paint can flow by gravity. A vented lid 46 can be provided if desired.

The reservoir 10 has an upwardly-facing opening 17 sized and shaped to receive a one-gallon paint can 40 as shown by broken lines in FIG. 2. A can holder or support, which in the illustrated embodiment is a stop or shelf 42 welded to the inside of the wall 12, extends radially inwardly and is positioned to support the paint bucket 40. As will be appreciated from FIG. 2, the reservoir 10 should be sized and shaped so that a standard paint can or bucket is supported on the shelf 42 and cannot slip down to the bottom wall 14. The support is located at a sufficient elevation to hold the can or bucket at an elevation above the surface of paint in the vessel after the contents of the can or bucket have been emptied into the vessel. The vessel can be of sufficient depth to entirely contain a paint can, or more practically, the can or bucket is only partially received in the vessel with a portion of the can or bucket extending above the top of the vessel as illustrated. In either arrangement, the vessel should be sized to hold the entire volume of paint received from a can or bucket at a location below the can or bucket supported in the vessel.

Although the illustrated embodiment is sized and shaped for use with one gallon paint cans, the apparatus can be made in other sizes. A particular, useful embodiment would be of sufficient size to receive five-gallon paint buckets.

Paint exits the reservoir 10 into a nipple 18 which is connected to the wall 14 by welding or other fluid-tight connection. The nipple has a centerline or axis A1. The nipple 18 is received in an internally threaded elbow 20. A threaded, horizontally extending header pipe 22 is received in the other opening of the elbow 20 and into one opening of a swivel connector 24 which has a swiveling coupler head 26. The swiveling coupler head defines an outlet that has a centerline or axis A2.

Figure 3:
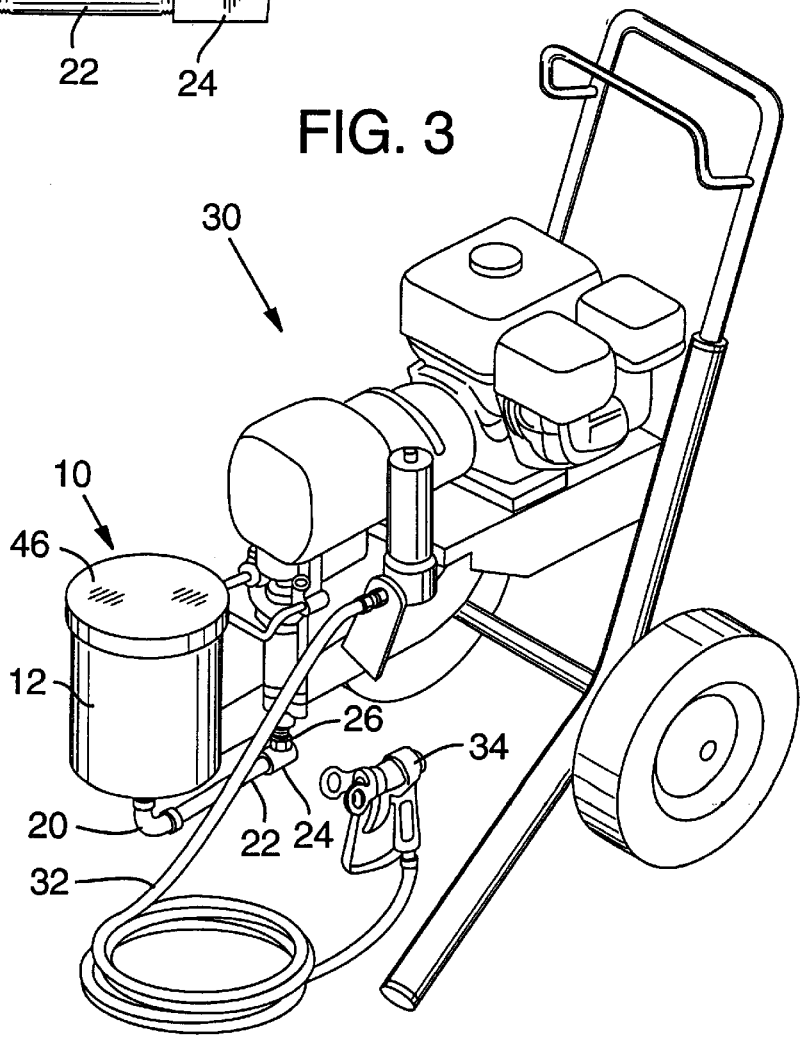
FIG. 3 is an oblique schematic view showing a paint supply reservoir connected to a pump and spray gun mechanism.

As best seen in FIG. 3, the swiveling coupler head 24 connects to an externally threaded, downwardly-opening intake pipe (not shown) on a pump assembly 30. The pump discharges paint through a spray tube 32 to a nozzle or gun 34. The pump mechanism can be of conventional design.

The distance D between the axis A1 of the opening 16 and the axis A2 of the coupler 26 should be as small as possible, so that a minimal amount of paint is needed to fill the tube 22. Best results are achieved when the distance is less than the diameter of the reservoir wall 12. The minimum possible length of the tube 22 will be determined, to some extent, by the room available adjacent the paint inlet of the pump 30. But, again, the length should be as small as possible.

Some sprayer systems have an intake pipe that is not externally threaded or that is not downwardly-opening. It should be appreciated that the flow path and configuration of the coupler 26 could be altered, as necessary, to mate with the intake pipe of the pump being used. For example, if the pump assembly has a horizontally-opening intake pipe with a bayonet-type coupling, the tube 22 of the paint reservoir would terminate in a coupler (not shown) have a mating bayonet coupling and a straight-through flow path. It would still be best for the tube 22 to be as short as possible.

All portions of the reservoir and associated supply tubing are preferably made of stainless steel, although other corrosion-resistant materials, such as plastic materials, could be used. The materials used for the reservoir and supply tube should be rigid so that the reservoir is supported by the supply tube members 20, 22, 24 without further bracing.

Although the principles of the present invention are illustrated and described with reference to preferred embodiments, it should be apparent to those of ordinary skill in the art that the illustrated embodiments may be modified in arrangement and detail without departing from such principles. For example, the outlet need not be centered the bottom of the vessel, but can be offset, can be through the side of the vessel near the bottom, or otherwise can be located in like manner. The outlet can be provided by a short syphon tube which extends into the vessel, but such an arrangement is less useful due the difficulties of cleaning such a tube. Thus, the present invention includes not only the illustrated embodiments, but all such modifications, variations, and equivalents thereof as fall within the true scope and spirit of the invention.

We claim:

1. A paint supply system comprising:

a vessel that (a) defines an upwardly facing opening of sufficient size and of appropriate shape to receive a standard one-gallon paint can, (b) defines a reservoir cavity that is sized to hold a gallon of paint received from a standard one-gallon paint can, (c) has a holder to support a standard one-gallon paint can at an elevation above the bottom of the vessel, the holder being located at a sufficient elevation to hold the one-gallon paint can at an elevation above the surface of paint in the reservoir cavity when the reservoir cavity contains a gallon of paint, and (d) defines an outlet through which paint can be withdrawn from the vessel; and a conduit in communication with the outlet to carry paint from the vessel to a spray apparatus.

2. A paint supply system comprising:

a vessel that (a) comprises a side wall and a bottom wall that together define a reservoir cavity that is sized to hold a gallon of paint, the side wall defining an upwardly facing opening of sufficient size and of appropriate shape to receive a standard one-gallon paint can, (b) comprises a holder to support a standard one-gallon paint can, the holder being a shelf that extends radially inwardly from the wall and is positioned to support the rim of the one-gallon paint can so that the one-gallon paint can cannot slip down to the bottom of the reservoir cavity, the shelf being located at a sufficient elevation to hold the one-gallon paint can at an elevation above the surface of a gallon of paint in the reservoir cavity, and (c) defines an outlet through which paint can be withdrawn from the vessel;

a horizontally extending pipe connected to the outlet to receive paint from the reservoir; and a coupler to connect the pipe to a pump in such a manner that paint can be delivered to the pump from the pipe.

3. The paint supply system of claim 2 further comprising a nipple that defines a passageway in liquid-tight communication with the vessel outlet.

4. The paint supply system of claim 3 further comprising a hollow elbow that connects the nipple to the pipe so that paint can flow through the elbow as it moves from the nipple to the pipe.

5. The paint supply system of claim 2 wherein:

the sidewall of the vessel is generally cylindrical and is generally circular in horizontal cross-section;

the vessel outlet extends through the bottom wall of the vessel;

the coupler has an outlet that mates with an inlet of a pump; and the distance between the vessel outlet and the outlet of the coupler is less than the diameter of the vessel sidewall.

6. The paint supply system of claim 2 wherein the coupler is a swiveling coupler head.

7. The paint supply system of claim 6 wherein:

the swiveling coupler head defines an upwardly facing outlet; and the distance between the center of the vessel outlet and the center of the coupler outlet is less than the diameter of the vessel sidewall.

8. A paint supply system comprising:

a vessel that (a) comprises a side wall and a bottom wall that together define a reservoir cavity that is sized to hold five gallons of paint, the side wall defining an upwardly facing opening of sufficient size and of appropriate shape to receive a standard five-gallon paint container, (b) comprises a holder to support a standard five-gallon paint container, the holder being a shelf that extends radially inwardly from the wall and is positioned to support the rim of the five-gallon paint container so that the five-gallon paint container cannot slip down to the bottom of the reservoir cavity, the shelf being located at a sufficient elevation to hold the five-gallon paint container at an elevation above the surface of five gallons of paint in the reservoir cavity, and (c) defines an outlet through which paint can be withdrawn from the vessel;

a horizontally extending pipe connected to the outlet to receive paint from the reservoir; and a coupler to connect the pipe to a pump in such a manner that paint can be delivered to the pump from the pipe.

9. A paint spraying system comprising:

a pump for supplying pressurized paint to a spray gun, the pump having a paint inlet and a paint outlet;

a vessel that (a) defines an opening of sufficient size and of appropriate shape to receive a standard cylindrical paint container, (b) a holder to support a paint container at an elevation above the bottom of the vessel, and (c) an outlet through which paint can be withdrawn from the vessel, the vessel being rigidly mounted on the pump in such a manner that the paint outlet of the vessel is in communication with the paint inlet of the pump and the opening of the vessel faces upwardly; and a spray gun having a paint inlet in communication with the paint outlet of the pump.

10. A paint spraying system comprising:

a pump for supplying pressurized paint to a spray gun, the pump having a paint inlet and a paint outlet;

a vessel that (a) comprises a side wall and a bottom wall that together define a reservoir cavity that is sized to hold a gallon of paint, the side wall defining an opening of sufficient size and of appropriate shape to receive a standard one-gallon paint can, (b) comprises a holder to support a standard one-gallon paint can, the holder being a shelf that extends radially inwardly from the side wall and is positioned to support the rim of the one-gallon paint can so that the one-gallon paint can cannot slip down to the bottom of the reservoir cavity, the shelf being located at a sufficient elevation to hold the one-gallon paint can at an elevation above the surface of a gallon of paint in the reservoir cavity, (c) defines an outlet through which paint can be withdrawn from the vessel, the vessel being mounted on the pump such that the outlet of the vessel is in communication with the paint inlet of the pump and the opening of the vessel faces upwardly, and (d) comprises a cylindrical nipple connected to the bottom wall by a fluid-tight connection, the nipple having a cylindrical wall that defines a passageway that communicates with the vessel outlet;

a hollow elbow connected to the nipple to receive paint from the nipple;

a horizontally extending pipe connected to the elbow to receive paint from the elbow;

a coupler connect the pipe to the pump in such a manner that paint can be received into the paint inlet of the pump from the pipe, the distance between the outlet of the vessel and the outlet of the coupler being less than the diameter of the vessel side wall; and a spray gun having a paint inlet in communication with the paint outlet of the pump.

* * * * *